United States Patent [19]

Coffaro et al.

[11] 4,211,403

[45] Jul. 8, 1980

[54] WEIGHT LIFTING LEG EXERCISE DEVICE

[76] Inventors: Matthew Coffaro, 4190 Sierra Chapita, Tucson, Ariz. 85715; Ronald L. Pelton, 7402 E. Thirty-eighth St., both of Tucson, Ariz. 85730

[21] Appl. No.: 929,124

[22] Filed: Jul. 28, 1978

[51] Int. Cl.[2] ..... A63B 21/00

[52] U.S. Cl. ..... 272/134; 272/900; 272/143; 272/DIG. 4

[58] Field of Search ..... 272/123, 122, 117, 116, 272/134, 143, 144, DIG. 4, 900

[56] References Cited

U.S. PATENT DOCUMENTS

| | | | |
|---|---|---|---|
| 2,305,548 | 12/1942 | Nichols | 272/126 |
| 3,118,668 | 1/1964 | Callahan | 272/123 X |
| 3,306,611 | 2/1967 | Gaul | 272/118 |
| 3,373,993 | 3/1968 | Oja | 272/142 X |
| 3,640,527 | 2/1972 | Proctor | 272/118 |
| 3,708,167 | 1/1973 | Potgieter | 272/117 |
| 3,734,495 | 5/1973 | Nist et al. | 272/DIG. 4 X |
| 3,815,903 | 6/1974 | Blomquist | 272/117 |
| 3,858,873 | 1/1975 | Jones | 272/117 |
| 3,976,058 | 8/1976 | Tidwell | 272/144 X |
| 4,010,947 | 3/1977 | Lambert | 272/118 |
| 4,125,258 | 11/1978 | McArthur | 272/DIG. 4 X |

*Primary Examiner*—William R. Browne
*Attorney, Agent, or Firm*—J. Michael McClanahan

[57] ABSTRACT

A leg exercise device for a person exercising their legs while lying on their back on a exercise bench, the leg exercise device attaching to the rear portion of the exercise bench, the device having a cross-arm above the level of the bench to receive the person's feet, the cross-arm attached to the end of a lever mechanism having its fulcrum operably attached to the legs of the bench, the other end of the lever attached to an extension rod running underneath the bench to operably engage weights suspended on the end of a pivotal lever, the extension rod engaging the pivotal lever such as to rotate the weights upward when the cross-arm is urged away from the person operating same and thereby exercise the person's legs and feet. By various other sitting or standing positions, the leg exercise device may be exercised by the person's arms and shoulders.

3 Claims, 2 Drawing Figures

WEIGHT LIFTING LEG EXERCISE DEVICE

BACKGROUND OF THE INVENTION

Many devices have been made and patented dealing with the sport of exercising parts of the human body by lifting weights. These devices have been relatively complex requiring the use of pluralities of cables, pulleys, and levers, which, due to their construction, require that the exercise device be attached to walls or that there should be a permanent type of attachments of the device to the floor. In some cases large stable platforms must be constructed to set on the floor, the weight of the platform being such that it exceeds the weight and forces which are directly involved in the exercise. The reason these exercise devices must be attached to a wall or floor is that in many cases during usage, the devices exert forces in directions other than toward the floor and the magnitude of the exerted forces is greater than the weight of the device. This causes an imbalance in the device which renders the device unstable causing it to overturn or some other drastic result.

The commonly available bench rest to which the invention attaches is of the type that consists of a flat board, usually padded, having a pair of elongated pieces of tubing running the length of the bench, bending down to form a pair of legs at the bench rear portion, and at the other end, bending to turn on themselves in a "U" shaped to separately engage upright struts, the struts forming the front two legs and continuing on upward to attach to saddle shaped brackets to receive a weighted barbell. A weight exerciser will lay, back down, upon the bench with his feet on either side of the bench to the floor, his head generally between the upright struts, reaching up to grasp the barbell bar resting in the brackets, lifting same and then letting it down into the brackets.

The commonly available bench rest described above does not provide a great deal of different types of exercises, but yet it does provide a readily moveable nonpermanent type platform to hold a person's body for adaptation of other types of exercises providing the added equipment is devised where all forces that are exerted in utilizing the equipment are such that the equipment itself or the bench construction provides the resisting force and no connection is necessary to a floor or wall.

The inventors have invented another invention, which is the subject of a prior patent application, and which attaches to existing bench rests for exercising the arms and shoulder.

Thus it is apparent that there is need for a leg exercising device which is rather compact and portable and which does not depend upon attachment to floors or to walls to be used but which is in fact arranged so that the forces exerted by the device when in operation are such that attachment to walls and floors are not necessary and attachment to a bench rest may be made.

SUMMARY OF THE INVENTION

In accordance with the present invention, a leg exercise device is shown and described where a lever arm suspends a crossarm in the air at an appropriate height for a person lying, back down, upon a bench rest who may place his feet upon the crossarm and move restraining weights by pushing away the crossarm with his feet. To this end, the lever arm aforementioned is pivoted about a fulcrum attached to the bench rest legs where the other end of the lever arm pivotally connects with an extension rod which underlies the length of the bench. This extension rod engages, in lifting type arrangement, weights suspended at the end of a pivotal arm, the extension rod so arranged that the weight pivotal arm is raised when the crossarm is moved away from the bench rest and exercise thereby provided the person. The extension rod, in operably moving the weights, pivots an arm connected to the weight extension arm. Means are also provided by which to vary the height of the crossarm upon which the party places their feet.

A party, lying back down upon the bench rest, in a modified crouch position, engages the crossarm with their feet and by pushing away, lifts the weights and are thereby provided their exercise.

Accordingly, it is an object the present invention to provide a leg exercising device which does not require attachment to walls or to floors.

Further, it is another object of subject invention to provide a leg exercising device whereby a person can strengthen their legs pushing out from a crouched position.

It is still another object of the subject invention to provide a leg exercise device which is readily attachable to existing bench rests in order to provide additional exercises for the bench rest.

DETAILED DESCRIPTION OF PREFERRED EMBODIMENT

Figure 1:
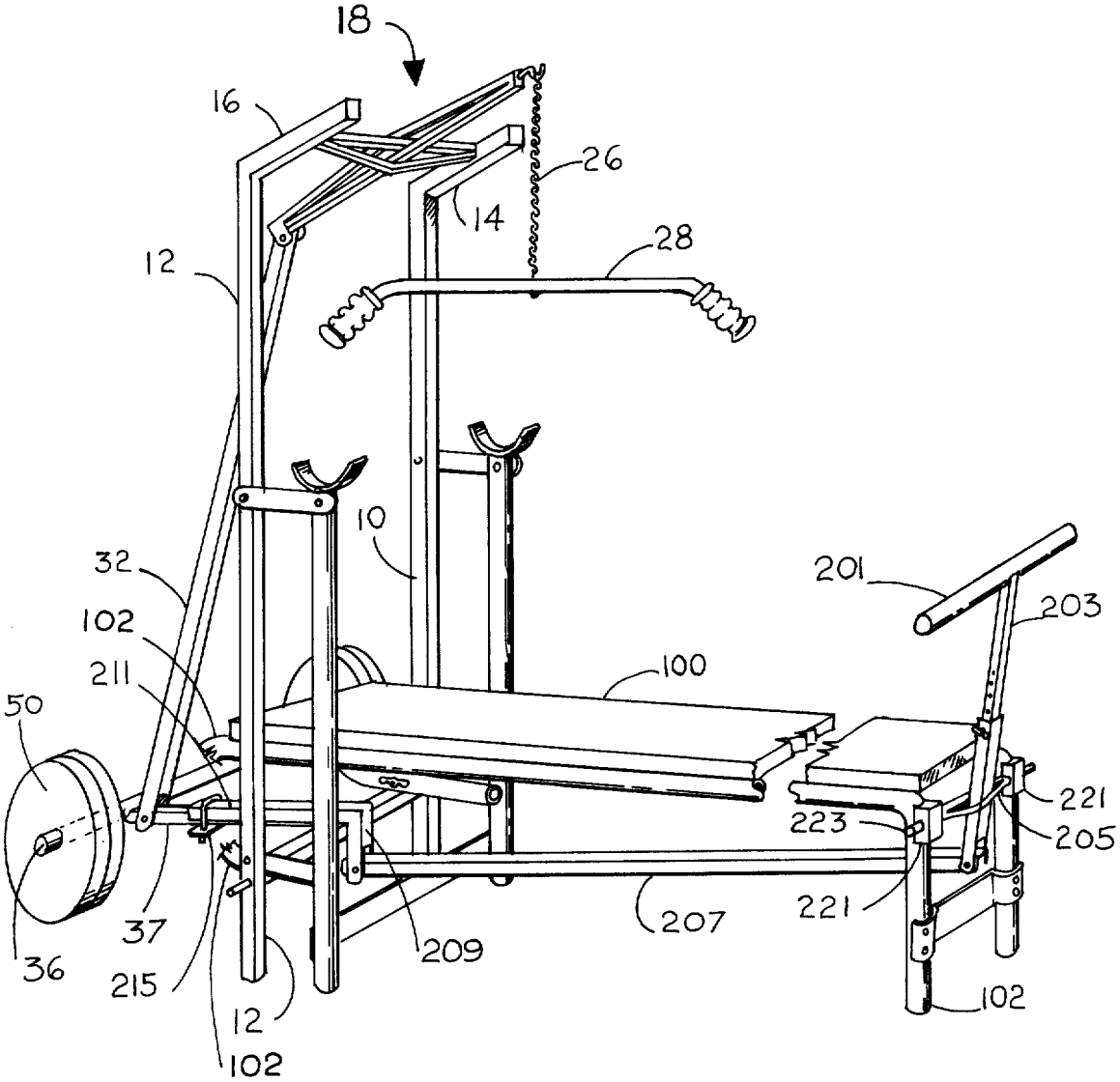
FIG. 1 is a perspective view of the subject invention in place attached to a bench rest and working in conjunction with weights suspended from a pivotal arm.

Referring now to FIG. 1, the preferred embodiment of the leg exercise device in placement and in combination with the weight exercise device for exercising the arms and the bench rest is shown. The weight exercise device attached to the bench 100 comprises upright legs 10 and 12 with their attached extension arms 16 and 14 with lever assembly 18 pivoting there between, handle 28 attached to a chain 26 connecting, in turn, to lever assembly 18, which by means of extension 32, lifts weights 50 residing on weight extension bar 36. Weight extension bar 36 pivots about cross arm 38 (not shown, but covered by angle iron 213), which in turn has pivotal pin 52 attached to it and which extends through upright leg 12. Metal tubing 102, which forms one of the end legs, runs underneath the back resting portion of the bench rest, and curves upon itself at the front portion to attach to front leg 12. An exerciser, sitting upon the bench, reaches up and pulls down handle 28 which, by acting through lever arm assembly 18 and extension 32, lifts weights 50. All the above was explained in more detail in Applicants' Patent Application entitled Weight Exercise Device, bearing Ser. No. 898,091, and filed Apr. 20, 1978, which application is incorporated herein by reference.

The improvement which the Applicants have added to the bench rest and which utilizes a portion of their prior invention in new inventive concept is the leg exercise device shown in FIG. 1 which joins on to extension arm 37 of Applicants' prior invention to utilize in the present invention and which is operated by the exerciser's feet and legs. More specifically the exerciser lays, back down, upon bench rest 100 and places his feet upon the feet receiving cross arm 201. There, the pressure applied by the feet in a generally horizontal direction away from the exercise device is transmitted through the lever bar 203 by means of the pivotal fulcrum 205 to extension rod 207 which pivotally joins the opposite end of lever bar 203 to arm 209. Arm 209 is in turn attached at right angles to second arm 211 which parallels and lays on top of weight extension arm 37 and is fastened thereto by "U" clamp 215. Attached at the junction of arm 207 and second arm 211 is 90° angle iron 213 which is so situated at the junction that one side of the angle iron joins with arm 209 and the other side of the angle iron joins with second arm 211. This places the open portion of the angle iron in such a position that it rests upon the cross bar 38 covered up by the angle iron but which has attached to it at its ends pivotal pins 52 which pass through legs 10 and 12.

The remaining portion of the structure to be discussed in the pivotal fulcrum 205 and its relationship to bench rest 100 legs 102. Attached to legs 102 are blocks 221 which have been drilled through their center to receive the central pin 223 which comprises the pivotal means of the fulcrum structure 205 interposed between legs 102. Pivotal fulcrum 205 then pivots, through means of central pin 223, about blocks 221.

In operation the subject invention functions as follows. The operator or exerciser places the soles of his feet upon cross arm 201 and then pushes outward away from the weight exercise device. This movement is translated along lever arm 203 and pivotally about fulcrum 205 to weight extension rod 207 and to arm 209. Arm 209, being urged in the direction opposite cross arm 201, then lifts up second arm 211, pivoting about the angle iron 213, which rests upon pivotal cross arm 38. Since lever 211 is held to weight extension arm 37 by means of "U" clamp 215, weight extension rod 36, with weights 50 thereupon, is lifted. After the operator completes his horizontal urging of cross arm 201, the weights 50, being pulled back down by gravity, urge the cross arm 201 to back towards the operator where, upon its travel limit, is ready for the exerciser to repeat his operation. This is continued until the exerciser determines he has had enough. Obviously, the exerciser may also operate cross arm 201 by his arms, either in a standing or sitting position.

Figure 2:
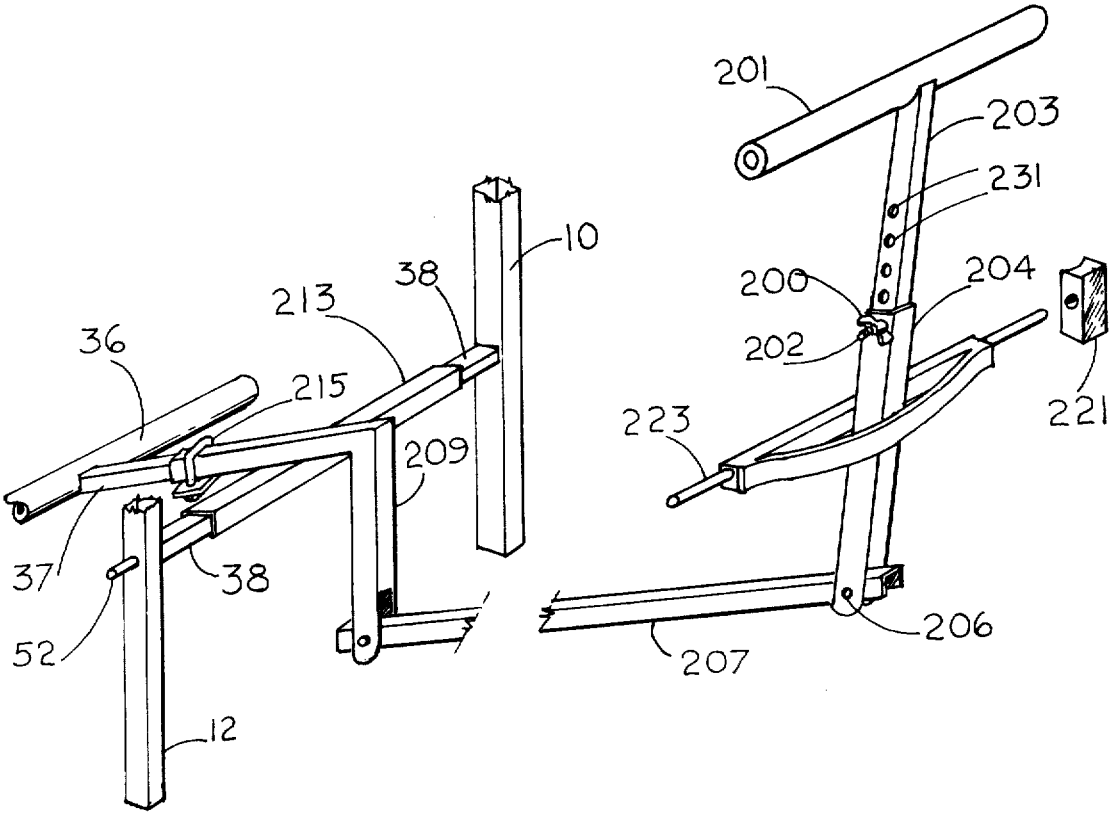
FIG. 2 is a perspective view of the combination of elements in the subject invention for attachment to the bench rest and weight extension arm.

Referring now to FIG. 2, a perspective view of the elements which comprise the leg exercise device are shown in detail, absent the bench rests to which they are attached.

In FIG. 2, crossarm 201 is shown atop lever bar 203 which slides into lever bar extension 204 and which is held in place by bolt 202 upon which butterfly nut 200 is screwed. Penetrating lever 203 are a plurality of openings 231 through which bolt 202 is inserted. This permits height adjustment of crossarm 201. Lever bar extension 204 is welded or permanently attached to pivotal fulcrum 205 which comprises a generally square metal structure with securing strap around lever bar extension 204 and which has central pin 223 protruding from both ends. Central pip 223 engages an opening in block 221 which fits onto legs 102 (not shown) of the bench. Lever bar extension 204 continues beyond the pivotal fulcrum 205 to its saddle-shaped end where it connects with extension rod 207 in pivotal relationship. Rod 207 is held interiorly to the sides of the bifurcation formed in the end of lever bar extension 204 by means of pivotal pin 206. Similarly, extension rod 207 is held in the bifurcated end of arm 209 by means of pivotal pin 210. At the opposite end of arm 209 is the attachment of second arm 211 which is at right angles of arm 209. Since square tubular steel is suggested throughout the invention except where it is obvious other types of metal are used, the 90° angle formed between arm 209 and second arm 211 may be formed by cutting a notch in the metal, bending at the junction, and then welding the junction. As incidated earlier, angle iron 213 is also welded into the 90° corner of arms 209 and 211. The "U" clamp 215 which attaches to weight extension rod 37 of the prior weight exercise device. Angle iron 213 rides upon, but is not fastened to in the preferred embodiment, crossarm 38 which is shown in this figure and which pivots about legs 10 and 12 by means of pivotal pins 52 which protrude legs 10 and 12, the pin at the ends of crossarm 38.

Attached to weight extension rod 37 is weight extension bar 36 upon which the weights that are desired to be lifted are placed.

While a preferred embodiment of the invention has been shown and described, it would be understood that there is no intent to limit the invention by such disclosure, but rather, it is intended to cover all modifications and alternate constructions falling within the spirit and the scope of the invention as defined in the appended claims.

We claim:

1. In combination, a weight exercise device for attaching to a weight-lifting bench, the weight exercise device comprising cross arm means to receive a person's members; first lever means attaching at a first end to said cross arm means, said first lever means including first fulcrum means operably attached to a first end of the weight-lifting bench for receiving an intermediate portion of the first lever means, said cross arm and a portion of said first lever means extending above the bench; and weight-lifting means adapted to receive associated weights, said weight lifting means also including second lever means pivotally attached to the weight-lifting bench adjacent the second end thereof, said second lever means first end pivotally attached to said first lever means second end through a substantially rigid connecting member, the first lever means and said second lever means comprising, respectively, only one single member each, and said second lever means second end being attached to the associated weights whereby when a person pivotes said cross arms means, the movement of the cross arms means is transmitted through the first lever means, the connecting member and through the second lever means to the attached associated weights to raise or lower the associated weights by pivoting of the second lever means in response to movement of the connecting member and thus provide exercises for the person's members.

2. The weight exercise device as defined in claim 1 wherein said weight-lifting means second lever means pivotally attached to the weight lifting bench adjacent the second end thereof defines second fulcrum means operable attached adjacent the weight-lifting bench second end.

3. The weight exercise device as defined in claim 2 wherein said weight-lifting means further includes upright leg means operably attached to the weight-lifting bench second end, said upright leg means adapted to receive said second fulcrum means.

* * * * *